US005282757A

United States Patent [19]

Maeda

[11] Patent Number: 5,282,757

[45] Date of Patent: Feb. 1, 1994

[54] CONNECTOR

[75] Inventor: Akira Maeda, Shizuoka, Japan

[73] Assignee: Yazaki Corporation, Japan

[21] Appl. No.: 879,300

[22] Filed: May 7, 1992

[30] Foreign Application Priority Data

May 16, 1991 [JP] Japan ..... 3-34580[U]

[51] Int. Cl.[5] ..... H01R 13/645

[52] U.S. Cl. ..... 439/374; 439/677

[58] Field of Search ..... 439/374, 376, 651, 677, 439/297, 680

[56] References Cited

U.S. PATENT DOCUMENTS

| | | | |
|---|---|---|---|
| 4,403,824 | 9/1983 | Scott | 439/680 |
| 4,764,129 | 8/1988 | Jones et al. | 439/680 X |
| 5,002,497 | 3/1991 | Plocek et al. | 439/247 X |

FOREIGN PATENT DOCUMENTS 61-26280 2/1986 Japan .

*Primary Examiner*—Eugene F. Desmond

*Attorney, Agent, or Firm*—Wigman, Cohen, Leitner & Myers

[57] ABSTRACT

A connector for electrically connecting wires to each other is disclosed. The connector comprises a male connector element and a female connector element having a fitting hood section into which the male connector element is fitted. The male connector element has a rectangular fitting surface which is directed or oriented toward the female connector element at fitting. The fitting surface has corners at which cut-out portions withdrawn inwardly are formed, respectively.

6 Claims, 5 Drawing Sheets

CONNECTOR

BACKGROUND OF THE INVENTION

The present invention relates to a connector comprising a male connector element having a rectangular fitting surface and a female connector element fitted over the male connector.

FIG. 1 of the attached drawings shows a connector 1 which is disclosed in Japanese Utility Model Laid-Open No. SHO 61-26280. As shown in FIG. 1, the connector 1 comprises a male connector element 3 having a rectangular fitting surface 9a and a female connector element 7 having a fitting hood section 5 which is fitted over the male connector element 3.

The male connector element 3 is formed with a plurality of terminal accommodating chambers 11, within a connector body 9 which is formed with the rectangular fitting surface 9a. A plurality of female terminal parts (not shown), which are connected in caulking respectively to ends of wires 12, are accommodated or received respectively in the terminal accommodating chambers 11.

On the other hand, the female connector element 7 is formed with a plurality of terminal accommodating chambers 17 within a housing section 15 which is formed in integral relation to the fitting hood section 5. A plurality of male terminal parts 19, which are connected in caulking respectively to the ends of the wires 12, are accommodated respectively in the terminal accommodating chambers 17. The male terminal parts 19 have respective forward ends thereof which project into the fitting hood section 5.

In order to fit the male connector element 3 arranged as described above, into the fitting hood section 5 of the female connector element 7, the connector body 9 is positioned such that the connector body 9 is under a straight or facing condition with respect to the fitting hood section 5 and, subsequently, one of the male connector element 3 and the female connector element 7 moves toward the other and are urged toward the other in such a direction that they approach each other. By doing so, the connector body 9 of the male connector element 3 is fitted in the fitting hood section 5 of the female connector element 7, and the male terminal parts 19 projecting into the fitting hood section 5 are inserted respectively into female terminal parts (not shown) which are accommodated respectively within the terminal accommodating chambers 11 in the connector body 9, so that the male and female connector elements 3 and 7 are electrically connected to each other.

As shown in FIG. 2, however, when the connector body 9 is inserted into the fitting hood section 5, there is a case where the connector body 9 is inserted under an inclined condition with respect to the fitting hood section 5.

In this case, the connector body 9 inclined with respect to the fitting hood section 5 is so-called prized or wrenched whereby an attempt is made to insert the connector body 9 into the fitting hood section 5 by force or unreasonably. For this reason, it may often occur that the male terminal parts 19 in contact with corners 21 of the connector body 9 are deformed and broken.

SUMMARY OF THE INVENTION

It is therefore an object of the invention to provide a connector in which, even if a male connector element having a rectangular fitting surface is inserted under an inclined condition with respect to a fitting hood section of a female connector element, there is no case where male terminal parts within the fitting hood section are deformed and broken.

In order to achieve the above-described object, according to the invention, there is provided a connector comprising:

a male connector element having a rectangular fitting surface, the fitting surface having corners which are formed respectively with cut-out portions withdrawn inwardly; and a female connector element having a fitting hood section into which the male connector element is fitted.

With the arrangement of the invention, the male connector element is inserted into the fitting hood section of the female connector element, whereby it is possible to fit the male connector element into the female connector element.

At this time, even if the male connector element is inserted under an inclined condition with respect to the fitting hood section of the female connector element, the forward ends of the male terminal parts which project into the fitting hood section are not into contact with the corners of the fitting surface by the cut-out portions formed in the male connector element.

Accordingly, even if the male connector element is inserted under the inclined condition with respect to the fitting hood section, there is no case where the male terminal parts within the fitting hood section are broken, by the corners of the male connector element adjacent to the fitting surface thereof.

DETAILED DESCRIPTION OF THE PREFERRED EMBODIMENTS

Figure 1:
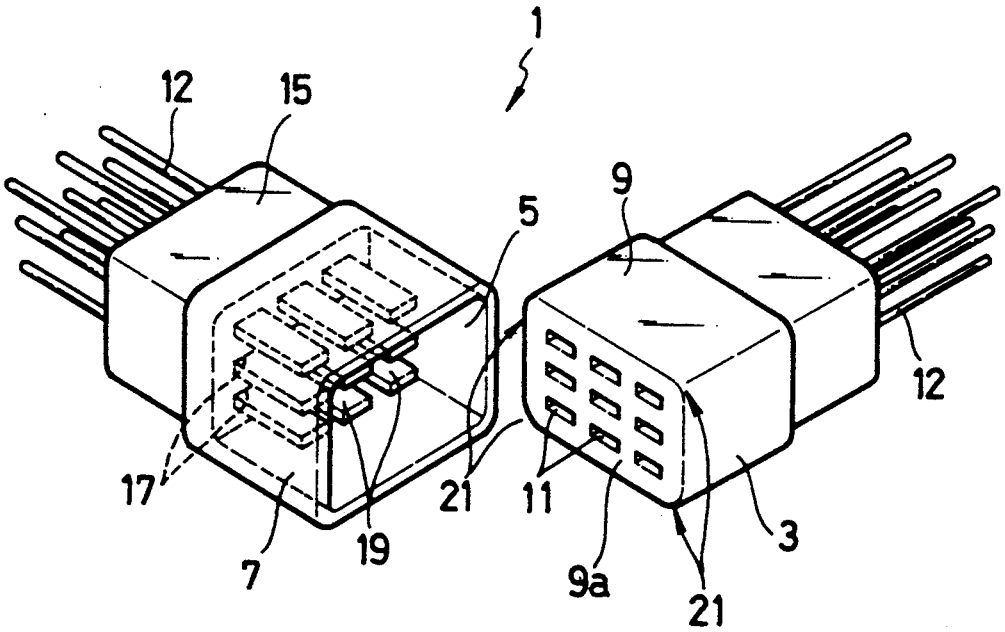
FIG. 1 PRIOR ART
FIG. 1 is a perspective view showing a conventional connector.
Figure 2:
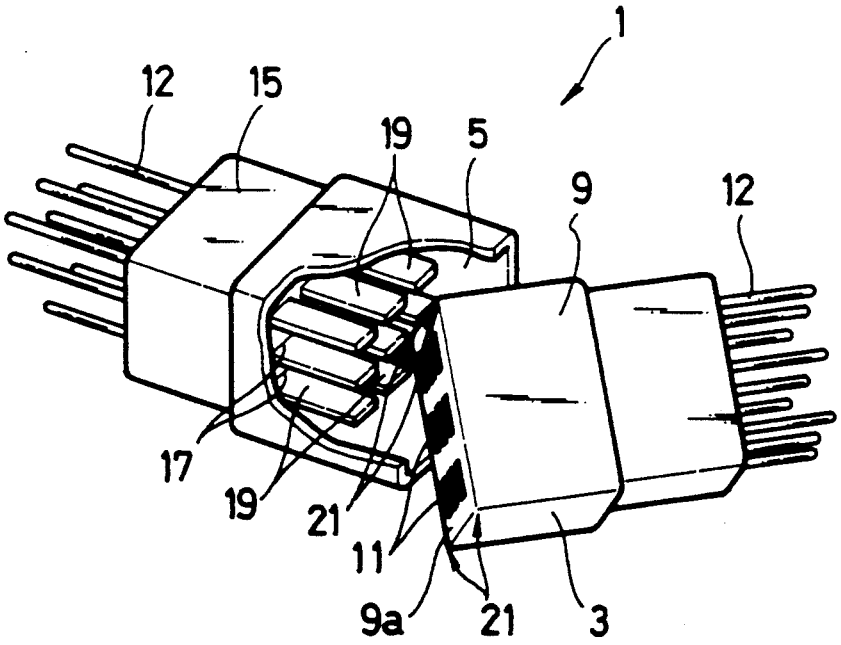
FIG. 2 PRIOR ART
FIG. 2 is a perspective view showing a condition under which a male connector element is inserted under an inclined condition with respect to a fitting hood section of a female connector element, in the conventional connector.
Figure 3:
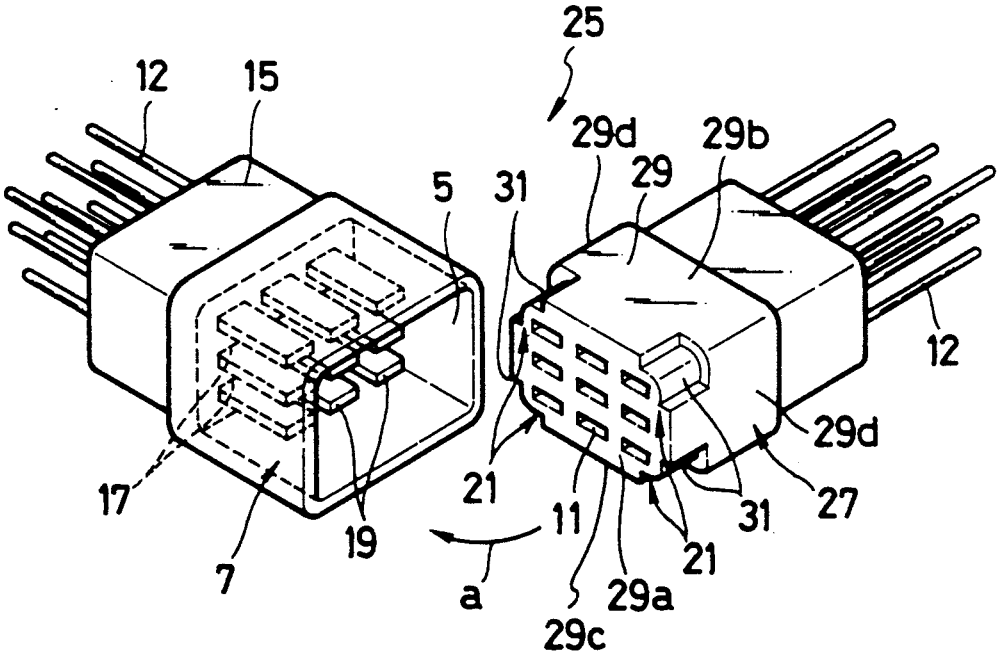
FIG. 3 is a perspective view showing an embodiment of a connector according to the invention.
Figure 4:
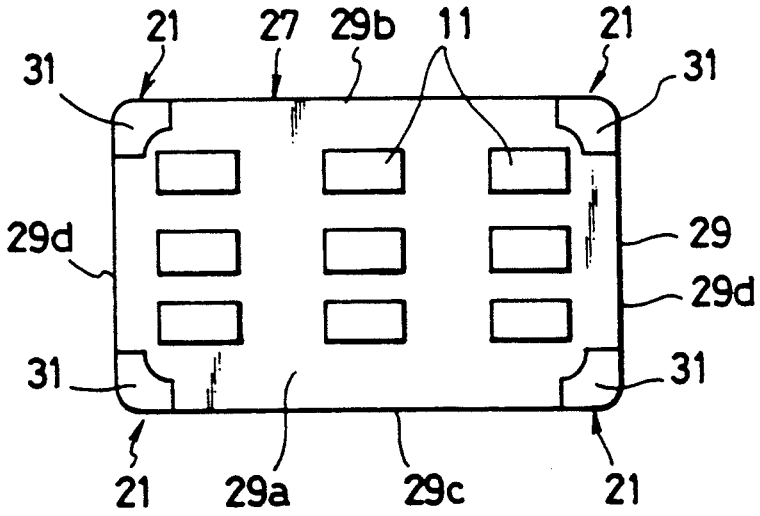
FIG. 4 is a front elevational view showing a male connector element in the embodiment illustrated in FIG. 3.

An embodiment of a connector according to the invention will hereunder be described in detail with reference to FIGS. 3 to 5 of the accompanying drawings.

As shown in the figures, a connector 25 comprises a male connector element 27 having a rectangular fitting surface 29a and a female connector element 7 having a fitting hood section 5 which is fitted over the male connector element 27.

The male connector element 27 is formed with a plurality of terminal accommodating chambers 11 in a connector body 29 which is formed with the rectangular (elongated rectangular, for example) fitting surface 29*a*. A plurality of female terminal parts (not shown) connected in caulking respectively to ends of wires 12 are accommodated or received respectively within the terminal accommodating chambers 11.

On the other hand, the female connector element 7 is formed with a plurality of terminal accommodating chambers 17 within a housing section 15 which is formed in integral relation to the fitting hood section 5. A plurality of male terminal parts 19 connected in caulking respectively to the ends of the wires 12 are accommodated respectively within the terminal accommodating chambers 17. The male terminal parts 19 have respective forwards ends thereof which project into the fitting hood section 5.

The male connector element 27 has the fitting surface 29*a* which is arranged at a location directed or oriented toward the female connector element 7 at fitting. The fitting surface 29*a* is formed with four (4) corners 21 at respective locations between an upper surface 29*b*, a lower surface 29*c* and both side surfaces 29*d* of the connector body 29. These corners 21 are formed with respective cut-out portions 31 which are evacuated, withdrawn or pulled back toward the interior of the connector body 29.

Figure 5:
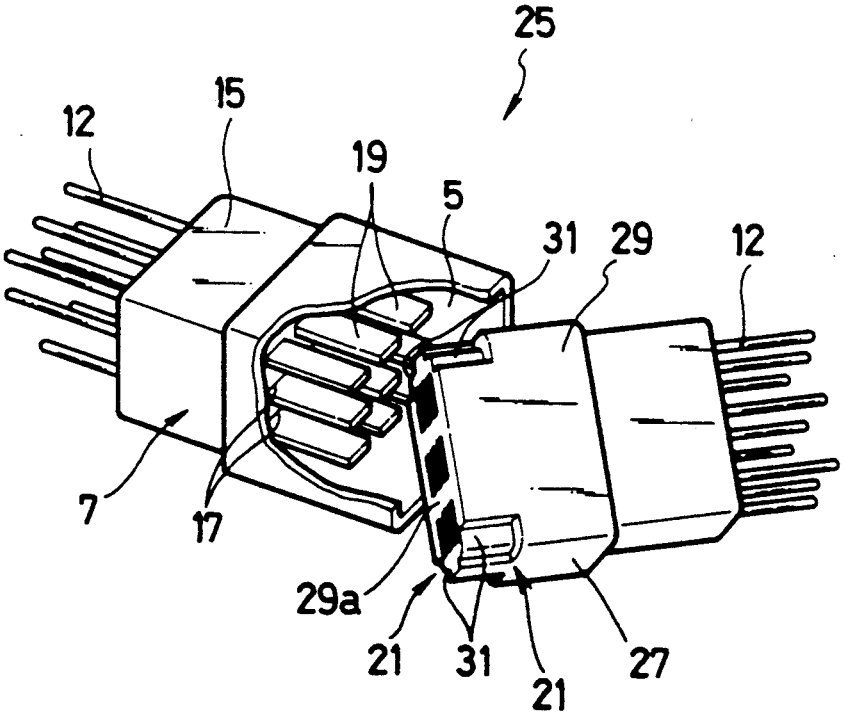
FIG. 5 is a perspective view showing a condition under which a male connector element is inserted under an inclined condition with respect to a fitting hood section of a female connector element, in the embodiment illustrated in FIGS. 3 and 4.

As shown in FIG. 5, each of the cut-out portions 31 is formed such that, even if the connector body 29 is inserted under an inclined condition with respect to the fitting hood section 5, a distance through which the corners 21 are inserted into the fitting hood section 5 is shortened correspondingly to a distance in a direction withdrawn toward the interior. Even if the connector body 29 is inserted under the inclined condition with respect to the fitting hood section 5, the forward ends of the respective male terminal parts 19 within the fitting hood section 5 are not into contact with the corners 21, and the forward ends of the respective male terminal parts 19 are spaced apart from the corners 21. In this connection, the distance in the direction withdrawn toward the interior varies depending upon an inclined angle of the connector body 29 with respect to the fitting hood section 5, and the like, but is decided or determined such that a gap occurs between the corners 21 of the connector body 29 and the forward ends of the respective male terminal parts 19 within the fitting hood section 5, in any inclined angles.

In order to fit the male connector element 27 into the female connector element 7, the connector body 29 is positioned under a substantially straight or facing condition with respect to the fitting hood section 5, and one of the male connector element 27 and the female connector element 7 moves toward the other. By doing so, the male terminal parts 19 within the fitting hood section 5 are inserted respectively into the female terminal parts within the respective terminal accommodating chambers in the connector body 29 so that the male and female connector elements 27 and 7 are connected electrically.

When the connector body 29 of the male connector element 27 is inserted into the fitting hood section 5 of the female connector element 7, as shown in FIG. 5, even if the connector body 29 is inserted into the fitting hood section 5 under the condition that the connector body 29 is inclined with respect to the fitting hood section 5, the forward ends of the respective male terminal parts 19 within the fitting hood section 5 are not into contact with the corners 21 of the connector body 29 by the cut-out portions 31 which are formed respectively at the corners 21 of the connector body 29 adjacent to the fitting surface 29*a*.

Accordingly, even if the connector body 29 is inserted in force with respect to the fitting hood section 5 by prizing or wrenching thereto, there is no case where the male terminal parts 19 within the fitting hood section 5 are broken by the corners 21 of the connector body 29.

In connection with the above, the cut-out portions 31 formed respectively in the corners 21 are not limited to the configuration in the above-described embodiment. The cut-out portions 31 may have any configurations, if the cut-out portions 31 withdrawn inwardly are formed on the outer peripheral surface of the male connector element 27 and if the cut-out portions 31 are formed respectively at or in the corners 21 of the male connector element 27 adjacent to the fitting surface 29*a*.

Further, in the aforesaid embodiment, the substantially elongated rectangular fitting surface 29*a* is shown, as an example, as the rectangular fitting surface. However, the invention is applicable also to a male connector element having a substantially square fitting surface.

What is claimed is:

1. A connector comprising:

a male connector element having a rectangular fitting surface provided on a lateral face thereof, said fitting surface having corners which are notched at the outer periphery thereof, said notches extending from said fitting surface along the corners of the male connector element in a lengthwise direction; and a female connector element having a fitting hood section into which said male connector element is fitted, said female connector element accommodating a plurality of terminals projecting partially through said fitting hood section so that the leading edges of said terminals are retracted from a leading edge of said fitting hood section, whereby said notched corners are shaped to prevent contact interference with said terminals when said male connector is inserted into said fitting hood section at an oblique angle thereto.

2. A connector according to claim 1, wherein said fitting surface is formed into an elongated rectangular configuration.

3. A connector comprising:

a male connector body having a terminal receiving chamber opening to a rectangular lateral face of said body, the corners of said face being notched at the outer periphery thereof and extending to an intermediate position along the lengthwise dimension of the body; and a female connector body having a fitting hood section adapted to receive the male connector body, said female body accommodating a terminal projecting partially through said fitting hood section so that the leading edge of said terminal is retracted from a leading edge of said fitting hood section, wherein a cavity of each notch is shaped to prevent contact interference with said terminal when the male body is inserted into said fitting hood section at an oblique angle thereto prior to insertion of the terminal into the terminal receiving chamber.

4. A connector according to claim 3, wherein the cavities of said notches are shaped to prevent contact interference with the terminal subsequent to insertion of the terminal into the terminal receiving chamber.

5. A connector according to claim 3, wherein said male connector body includes a plurality of terminal receiving chambers opening to said lateral face.

6. A connector according to claim 5, wherein said female connector body accommodates a plurality of terminals projecting into said fitting hood section.

* * * * *